United States Patent [19]

Wagoner

[11] 4,126,311

[45] Nov. 21, 1978

[54] BULLET TRAP

[76] Inventor: Lewis R. Wagoner, Box 112, Saratoga, Wyo. 82331

[21] Appl. No.: 763,215

[22] Filed: Jan. 27, 1977

[51] Int. Cl.[2] ..... F41J 1/12

[52] U.S. Cl. ..... 273/102.4

[58] Field of Search ..... 273/102.4; 73/167

[56] References Cited

U.S. PATENT DOCUMENTS

| | | | |
|---|---|---|---|
| 197,398 | 11/1877 | O'Neill | 273/102.4 |
| 385,546 | 7/1888 | Decumbus | 273/102.4 |
| 840,610 | 1/1907 | Easdale | 273/102.4 |
| 1,844,581 | 2/1932 | Koehler | 273/102.4 |
| 2,013,133 | 9/1935 | Caswell | 273/102.4 |
| 2,308,672 | 1/1943 | Brady | 73/167 |
| 2,818,729 | 1/1958 | Ferguson | 73/167 |
| 3,379,974 | 4/1968 | Dryden | 73/167 |

FOREIGN PATENT DOCUMENTS

| | | | |
|---|---|---|---|
| 476,343 | 7/1915 | France | 273/102.4 |
| 6,353 of | 1908 | United Kingdom | 273/102.4 |

*Primary Examiner*—Richard C. Pinkham
*Assistant Examiner*—Lawrence E. Anderson
*Attorney, Agent, or Firm*—Sughrue, Rothwell, Mion, Zinn and Macpeak

[57] ABSTRACT

A bullet trap has an entry funnel with a throat of gradually reduced dimension, the funnel being tangentially secured to a tubular tank. A mouth at the exit end of the funnel throat is aligned with an opening in the tank to direct projectiles from the throat into the tank. The tank is closed at its top, and its open bottom is connected to a cone, the cone being of reduced diameter from its point of connection at the tank to its exit aperture. The cone interior may be corrugated to aid in disintegration of the projectile as the projectile expends its travel energy in rotation therein.

2 Claims, 6 Drawing Figures

FIG. 1
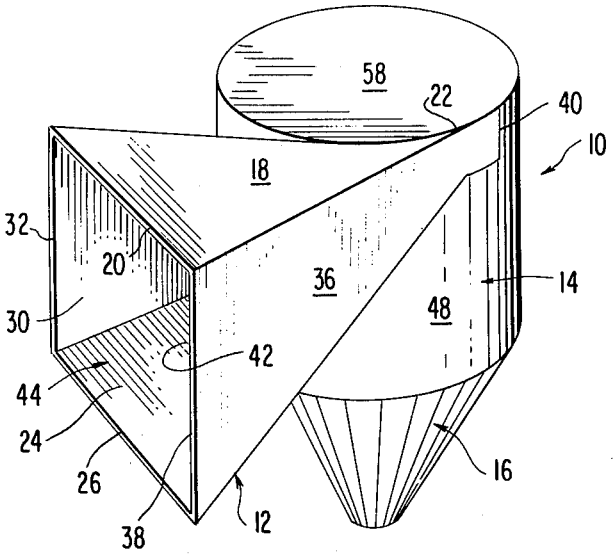
FIG. 2
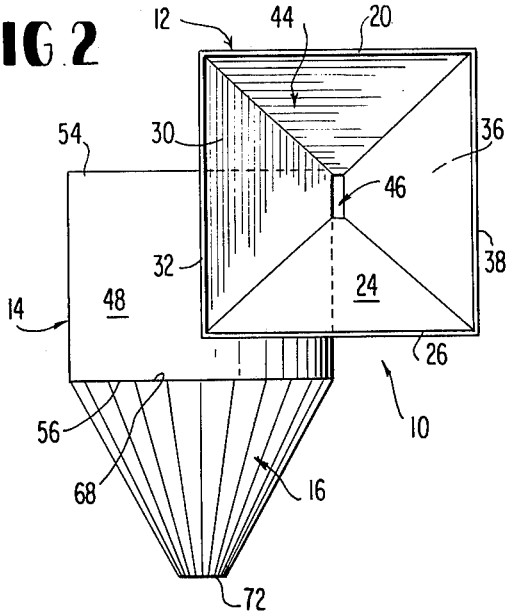
FIG. 3
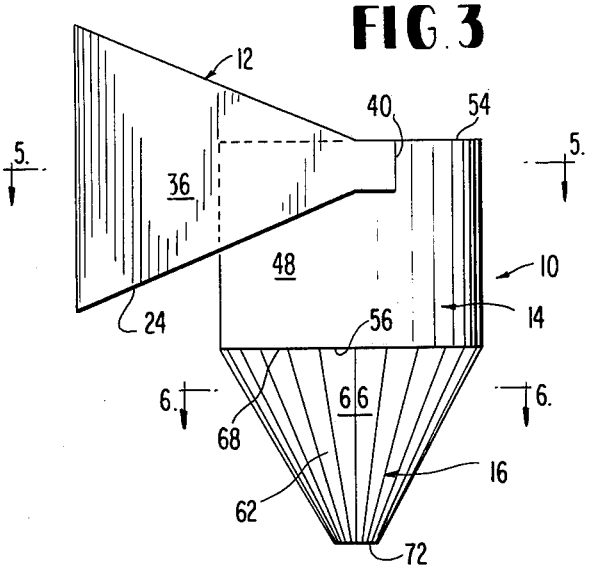
FIG. 5
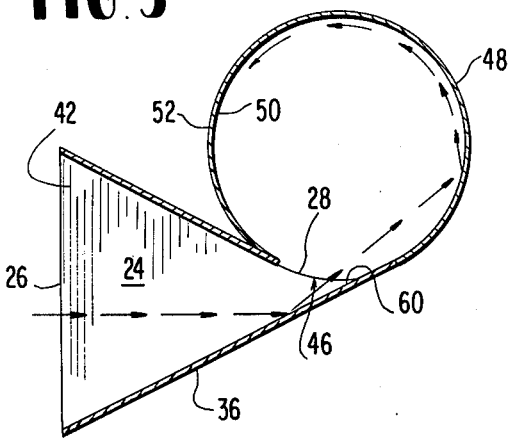
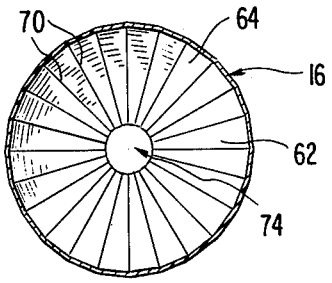
FIG. 6
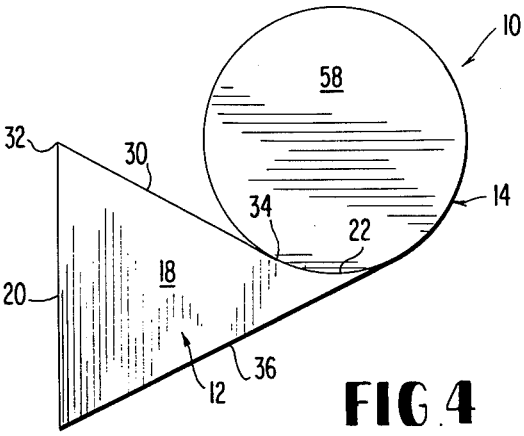
FIG. 4

BULLET TRAP

BACKGROUND OF THE INVENTION

1. Field of the Invention

This invention pertains to a bullet trap employed to entrap projectiles from firearms and the like.

2. Statement of the Prior Art

The general concept of energy depleting bullet trap devices has long been known, wherein a bullet enters a device through a throat and thereafter is trapped within a housing of some type. The present arrangement proposes a new and novel combination of entry funnel, tank and cone, as hereinafter detailed.

SUMMARY OF THE INVENTION

The present invention provides a unique bullet trap finding utility as a target backstop which may be employed by law enforcement agencies, military establishments, and like groups. The assembly provided hereby is adapted to effectively and safely contain projectiles from modern high velocity ammunition.

A principal objective hereof resides in the provision of a trap in which the projectile is effectively contained, and wherein the possibility of dangerous ricochet or escape of the projectile from the trap is eliminated.

The device provided hereby concentrates the projectile travel path upon entry, and directs the projectile into an enclosed area. The enclosed area is adapted to expend the residual energy of the fired projectile, and to frictionally reduce its velocity.

In addition, the frictional action of the invention apparatus serves to disintegrate the projectiles fired there into, and to expell the disintegrated waste for recycling.

Other and further objects and advantages of the invention will become apparent to those skilled in the art from a consideration of the following specification when read in conjunction with the annexed drawing.

BRIEF DESCRIPTION OF THE DRAWING

FIG. 1 is a perspective view of the bullet trap constructed and assembled in accordance with teachings of this invention;

FIG. 2 is a front elevational view of the invention;

FIG. 3 is a side view thereof;

FIG. 4 is a top plan view;

FIG. 5 is a sectional view on line 5—5 of FIG. 3, looking in the direction of the arrows;

FIG. 6 is another cross sectional view, taken on line 6—6 of FIG. 3, looking in the direction of the arrows.

DESCRIPTION OF THE PREFERRED EMBODIMENT

Referring to the drawing in more detail, a bullet trap according to this invention is therein generally identified by reference character 10. The trap has three principal components: an entry funnel 12, a tank 14, and a cone 16, described in detail hereinafter.

The funnel 12 comprises a series of walls including a top wall 18 having a leading end edge 20 and a trailing end edge 22, the wall being reduced in width from the edge 20 to the edge 22. A bottom wall 24 is identically configured, and has a leading end edge 26 and a trailing end edge 28. The funnel further includes an inner side wall 30 with a leading end edge 32 and a trailing end edge 34, and an outer side wall 36 which is substantially elongated relative to the inner side wall. The outer side wall also has a leading and edge 38 and a trailing end edge 40. The walls are connected at their respective side edges such that the funnel is provided with rectangular mouth 44, defined by the wall leading end edges, to an inside opening 46.

The funnel 12 is connected to the tank 14 with its general linear axis in substantially tangential relation to the perimeter of the tank. As shown, the tank comprises a tubular main tank wall 48 having inner and outer wall surfaces 50 and 52, and further having upper and lower wall edges 54 and 56. The tank is sealed at its upper end by a flat top wall 58 sealingly secured to the upper wall edge 54.

Formed in the main tank wall 48 at the upper wall edge 54 is a substantially rectangular orifice 60 (FIG. 5). The trailing end edges of the funnel walls are secured to the tank wall about the orifice 60 with the opening 46 co-aligned therewith.

The cone 16 comprises a cone wall 62 having opposite interior and exterior surfaces 64 and 66. The cone, when the unit is assembled, is of inverted frusto-conical form, and has a cone top edge 68 which is dimensioned ro underlie the lower wall edge 56 of the tank and if fixedly secured thereto, as by a continuous weld, or by a releaseable fastening means.

While the cone wall may be smooth, in the preferred embodiment, at least the interior surface 64 of the cone wall is provided with a series of recurring corrugations 70 or other regular or irregular surface projections. The cone lower end has a bottom edge 72 defining a remanent exit aperture 74.

In use, the trap 10 is mounted such that the mouth 44 of the funnel is in the path of fired projectiles, such as by location behind the target area. Bullets enter the throat through the mouth 44, in a typical and general case (excluding the unusual case of direct passage through the mouth 44 and out of the opening 46) strike the interior of one of the walls, being deflected and slowed by the wall contact or contacts until finally exiting through the opening 46. A typical path is shown by the arrows in FIG. 5. In either the general or the unusual case, the projectile then enters the tank and caroms in generally centrifugal fashion about its interior, its velocity being diminished by frictional contacts, and impacts serving also in many cases to effect disintegration. As this continues, the projectile reaches the cone where the wall contact is intensified by the gradually reducing diameter, and disintegration increases due to the corrugations. Finally, the remanents gravitate out through the exit to a suitable receptacle for recycling.

I claim:

1. A bullet trap comprising:

an entry funnel having top, bottom and inner and outer side walls; the walls each having an outer leading end edge and an inside trailing end edge, the walls having side edges and being connected at their respective side edges to one another, with the leading end edges defining a substantially rectangular, open mouth;

the walls being of reduced width from the leading end edges to the trailing end edges thereof to thereby define a throat of a dimension sequentially reduced from the mouth; a tank having a tubular main tank wall with inner and outer wall surfaces, the main wall having upper and lower wall edges;

a tank top wall fixedly secured to the upper edge of the main wall to sealingly close the tank thereat;

the main tank wall having a substantially rectangular orifice formed therein adjacent the upper edge thereof, and the inside trailing end edges of the entry funnel walls being fixedly secured to the main tank wall about said orifice to form an opening throat remote from said mouth and opening into the tank;

said funnel being substantially tangentially related to the tank;

a cone comprising a cone wall with interior and exterior surfaces, of inverted frusto-conical configuration, having a cone top edge dimensioned to underlie the lower wall edge of the main tank wall and being fixedly secured thereto; the cone wall interior surface having substantially vertically oriented corrugations formed therein; and the cone wall having an open bottom edge defining a bullet remanent exit aperture.

2. A bullet trap comprising:

an entry funnel comprising a plurality of funnel walls secured to one another and having an open mouth and an opening defining a throat of gradually reduced dimension from the mouth to the opening;

a tank having a tubular main tank wall, a top wall, and an orifice formed therein adjacent the top wall;

the entry funnel being connected in substantially tangential relationship to the main tank wall with said opening aligned with said orifice; said mouth being located partially above the tank wall with the opening disposed at the upper extremity of the tank;

the main tank wall having a lower wall edge;

a cone having a cone wall of inverted frusto-conical form fixedly secured to the lower wall edge of the main tank wall and having a bottom exit aperture; the cone wall having an interior surface with corrugations formed therein; and the corrugations being substantially vertically orientated.

* * * * *